US009213280B2

(12) United States Patent
Nagasaki et al.

(10) Patent No.: US 9,213,280 B2
(45) Date of Patent: Dec. 15, 2015

(54) IMAGE-FORMING APPARATUS SUPPLYING POWER TO HEAT GENERATING MEMBER USING PHASE CONTROL AND/OR WAVE NUMBER CONTROL

(71) Applicant: CANON KABUSHIKI KAISHA, Tokyo (JP)

(72) Inventors: Osamu Nagasaki, Suntou-gun (JP); Masafumi Monde, Yokohama (JP); Yuki Sugiyama, Suntou-gun (JP); Seiji Yokoyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/503,701

(22) Filed: Oct. 1, 2014

(65) Prior Publication Data

US 2015/0110513 A1 Apr. 23, 2015

(30) Foreign Application Priority Data

Oct. 21, 2013 (JP) ..... 2013-218604
Apr. 14, 2014 (JP) ..... 2014-082873

(51) Int. Cl.
*G03G 15/20* (2006.01)
*G03G 15/00* (2006.01)

(52) U.S. Cl.
CPC ..... *G03G 15/205* (2013.01); *G03G 15/80* (2013.01); *G03G 2215/2035* (2013.01)

(58) Field of Classification Search
CPC .. G03G 15/205; G03G 15/80; G03G 15/5004
USPC ..... 399/70, 69, 88
See application file for complete search history.

(56) References Cited

U.S. PATENT DOCUMENTS

| | | | | |
|---|---|---|---|---|
| 5,669,039 | A * | 9/1997 | Ohtsuka et al. | 399/68 |
| 5,966,562 | A * | 10/1999 | Maehara | 399/69 |
| 8,494,383 | B2 | 7/2013 | Shimura et al. | |
| 2010/0028037 | A1 * | 2/2010 | Song | 399/70 |
| 2010/0310267 | A1 | 12/2010 | Shimura et al. | |

(Continued)

FOREIGN PATENT DOCUMENTS

| | | | |
|---|---|---|---|
| JP | 10-74023 | A | 3/1998 |
| JP | 2009-210893 | A | 9/2009 |

(Continued)

OTHER PUBLICATIONS

U.S. Appl. No. 14/467,267, filed Aug. 25, 2014.

*Primary Examiner* — Sophia S Chen
(74) *Attorney, Agent, or Firm* — Fitzpatrick, Cella, Harper & Scinto

(57) ABSTRACT

An image-forming apparatus includes: an image forming unit which forms an unfixed toner image on a recording material; a fixing unit having a heat generating member which generates heat by power supplied from a commercial AC power source via a choke coil, the fixing unit heating the unfixed toner image formed by the image forming unit and thereby fixing the image to the recording material; and a control unit which controls the supply of power from the commercial AC power source to the heat generating member. The control unit supplies power to the heat generating member by control including phase control, during printing for performing an image forming operation by the image forming unit, and supplies power to the heat generating member by wave number control during standby for awaiting a print instruction.

29 Claims, 18 Drawing Sheets

(56) References Cited

U.S. PATENT DOCUMENTS

| | | | | |
|---|---|---|---|---|
| 2013/0142535 | A1* | 6/2013 | Jeong et al. | 399/69 |
| 2013/0266334 | A1 | 10/2013 | Shimura et al. | |
| 2013/0302046 | A1 | 11/2013 | Monde et al. | |

FOREIGN PATENT DOCUMENTS

| | | | |
|---|---|---|---|
| JP | 2011-18027 | A | 1/2011 |
| JP | 2012-88443 | A | 5/2012 |

* cited by examiner

FIG.6A

POWER SUPPLY IN 2 HALF-WAVES
HEAT GENERATING RESISTANCE VALUE OF 44Ω

| HALF-WAVE NO. IN WHICH POWER SUPPLIED AT 100% (NO.1 : 100% POWER SUPPLY) | P I t VALUE (ONE CONTROL CYCLE: 40 HALF-WAVES) |
|---|---|
| 2 | 0.81 |
| 4 | 0.52 |
| 6 | 0.43 |
| 8 | 0.51 |
| 10 | 0.57 |
| 12 | 0.59 |
| 14 | 0.57 |
| 16 | 0.56 |
| 18 | 0.55 |
| 20 | 0.55 |

FIG.6B

POWER SUPPLY IN 2 HALF-WAVES
HEAT GENERATING RESISTANCE VALUE OF 52 Ω

| HALF-WAVE NO. IN WHICH POWER SUPPLIED AT 100% (NO.1 : 100% POWER SUPPLY) | P I t VALUE (ONE CONTROL CYCLE: 40 HALF-WAVES) |
|---|---|
| 2 | 0.76 |
| 4 | 0.47 |
| 6 | 0.38 |
| 8 | 0.46 |
| 10 | 0.52 |
| 12 | 0.54 |
| 14 | 0.52 |
| 16 | 0.51 |
| 18 | 0.50 |
| 20 | 0.50 |

FIG.8

| NUMBER OF HALF-WAVES IN ONE CONTROL CYCLE | AMOUNT OF CHANGE IN PIt VALUE (BASED ON 34 HALF-WAVES) |
|---|---|
| 26 | 0.1 |
| 28 | 0.07 |
| 30 | 0.04 |
| 32 | 0.02 |
| 34 | – |
| 36 | −0.02 |
| 38 | −0.04 |
| 40 | −0.05 |
| 42 | −0.06 |
| 44 | −0.07 |

FIG.10A CONTROL CYCLE OF 34 HALF-WAVES POWER SUPPLY IN 2 HALF-WAVES

| HALF-WAVE NO. IN WHICH POWER SUPPLIED AT 100% (NO.1 : 100% POWER SUPPLY) | P I t VALUE |
|---|---|
| 2 | 0.86 |
| 4 | 0.57 |
| 6 | 0.48 |
| 8 | 0.56 |
| 10 | 0.62 |
| 12 | 0.64 |
| 14 | 0.62 |
| 16 | 0.61 |
| 18 | 0.60 |
| 20 | 0.60 |

FIG.10B

CONTROL CYCLE OF 68 HALF-WAVES
POWER SUPPLY IN 4 HALF-WAVES

| HALF-WAVE NO. IN WHICH POWER SUPPLIED AT 100% (NO.1 : 100% POWER SUPPLY) | P I t VALUE |
|---|---|
| 2, 3, 4 | 0.60 |
| 4, 7, 10 | 0.40 |
| 6, 11, 16 | 0.34 |
| 8, 15, 22 | 0.43 |
| 10, 19, 28 | 0.48 |
| 12, 23, 34 | 0.51 |
| 14, 27, 40 | 0.48 |
| 16, 31, 46 | 0.46 |
| 18, 35, 52 | 0.44 |
| 20, 39, 58 | 0.50 |

FIG.11

CONTROL CYCLE OF 32 HALF-WAVES
POWER SUPPLY IN 2 HALF-WAVES

| HALF-WAVE NO. IN WHICH POWER SUPPLIED AT 100% (NO.1 : 100% POWER SUPPLY) | P I t VALUE (CALCLUATED FOR INPUT POWER RATIO 5.9%) |
|---|---|
| 2 | 0.89 |
| 4 | 0.59 |
| 6 | 0.50 |
| 8 | 0.58 |
| 10 | 0.64 |
| 12 | 0.66 |
| 14 | 0.64 |
| 16 | 0.64 |
| 18 | 0.63 |
| 20 | 0.62 |

IMAGE-FORMING APPARATUS SUPPLYING POWER TO HEAT GENERATING MEMBER USING PHASE CONTROL AND/OR WAVE NUMBER CONTROL

BACKGROUND OF THE INVENTION

1. Field of the Invention

The present invention relates to an image-forming apparatus, such as an electrophotographic printer.

2. Description of the Related Art

A fixing apparatus (fixing unit) which heats an unfixed toner image formed on recording paper and thereby fixes the image to the recording paper is installed in image-forming apparatuses such as copying machines and printers, which use electrophotographic recording technology. In general, a heater of a fixing unit generates heat by receiving a supply of power from a commercial AC power source.

In order to satisfy toner image fixing performance, it is necessary to stabilize the temperature of the fixing unit during the fixing process. Therefore, in high-speed image-forming apparatuses in particular, phase control which controls the power supplied to the heater by controlling the conduction angle in the half-wave of the AC waveform, or control which combines phase control and wave number control (hereinafter, called hybrid control) is employed (Japanese Patent Application Publication No. 2011-018027). These types of control have a short control update cycle compared to wave number control, and therefore the power control cycle corresponding to the temperature of the fixing unit can be shortened, which is beneficial for stabilization of the temperature of the fixing unit.

By the way, there are demands to shorten the time period from the inputting of a print instruction, to the outputting of the first sheet of recording paper (the "first print-out time"). One solution for this is a method in which the fixing unit is warmed up by supplying electric power to the heater during standby while waiting for a print instruction. As described above, in an apparatus which supplies power to a heater with a waveform that includes a phase control waveform during printing (during a fixing process), it could be envisaged that power could be supplied with a waveform including a phase control waveform during standby also.

In general, a choke coil is introduced into the heater drive circuit of the fixing apparatus in order to suppress the generation of noise when supplying power to the heater. However, if phase control or hybrid control is employed for heater control, then a humming noise occurs in the coil of the heater drive circuit. Since the humming noise occurs when power is supplied with a waveform including a phase control waveform, then a humming noise occurs also during printing when phase control or hybrid control is used. During printing, the motor, and the like, operates, and the humming noise is not conspicuous because of the sound of these operating parts, but during standby, the operating parts that generate noise are halted and therefore the humming noise of the coil is conspicuous.

SUMMARY OF THE INVENTION

It is an object of the present invention to provide an image-forming apparatus which is capable of suppressing a humming noise of a coil, during standby, while ensuring responsiveness of heater control during printing.

A further object of the present invention is to provide an image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source via a choke coil; and a control unit which controls the supply of power from the commercial AC power source to the heat generating member, wherein the control unit:

supplies power to the heat generating member by control including phase control, during printing for performing an image forming operation by the image forming unit; and supplies power to the heat generating member by wave number control during standby for awaiting a print instruction.

A further object of the present invention is to provide an image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source via a choke coil;

a detection unit which detects a temperature of the fixing unit; and a control unit which controls the supply of power from the commercial AC power source to the heat generating member, the control unit controlling the supply of power to the heat generating member by wave number control using a prescribed number of half-waves of alternating current as one control cycle, in such a manner that the temperature detected by the detection unit becomes a target temperature during standby for awaiting a print instruction, wherein the control unit does not supply power to the heat generating member when, during standby, the detected temperature is lower than the target temperature and power supply in one control cycle has been performed a limit number of times.

Further features of the present invention will become apparent from the following description of exemplary embodiments (with reference to the attached drawings).

BRIEF DESCRIPTION OF THE DRAWINGS

FIGS. 6A and 6B are diagrams of the relationship between a power supply pattern and a Plt value for heat generating resistance values of two types;

FIG. 8 is a diagram of the relationship between the number of half-waves in one control cycle of heater control, and the Plt value;

FIGS. 10A and 10B are diagrams of the relationship between a power supply pattern and a Plt value for control cycles of two types;

FIG. 11 is a diagram of the relationship between a power supply pattern and a Plt value in a comparative example;

DESCRIPTION OF THE EMBODIMENTS

Now, with reference to the drawings, the implementation of the present invention will be described below in detail in an illustrative manner based on embodiments. However, the sizes, materials, shapes, relative arrangements, and the like of components described in the embodiments should be appropriately changed in accordance with the configuration of an apparatus to which the invention is applied or with any of various conditions. That is, the scope of the invention is not intended to be limited to the following embodiments.

First Embodiment

Figure 1:
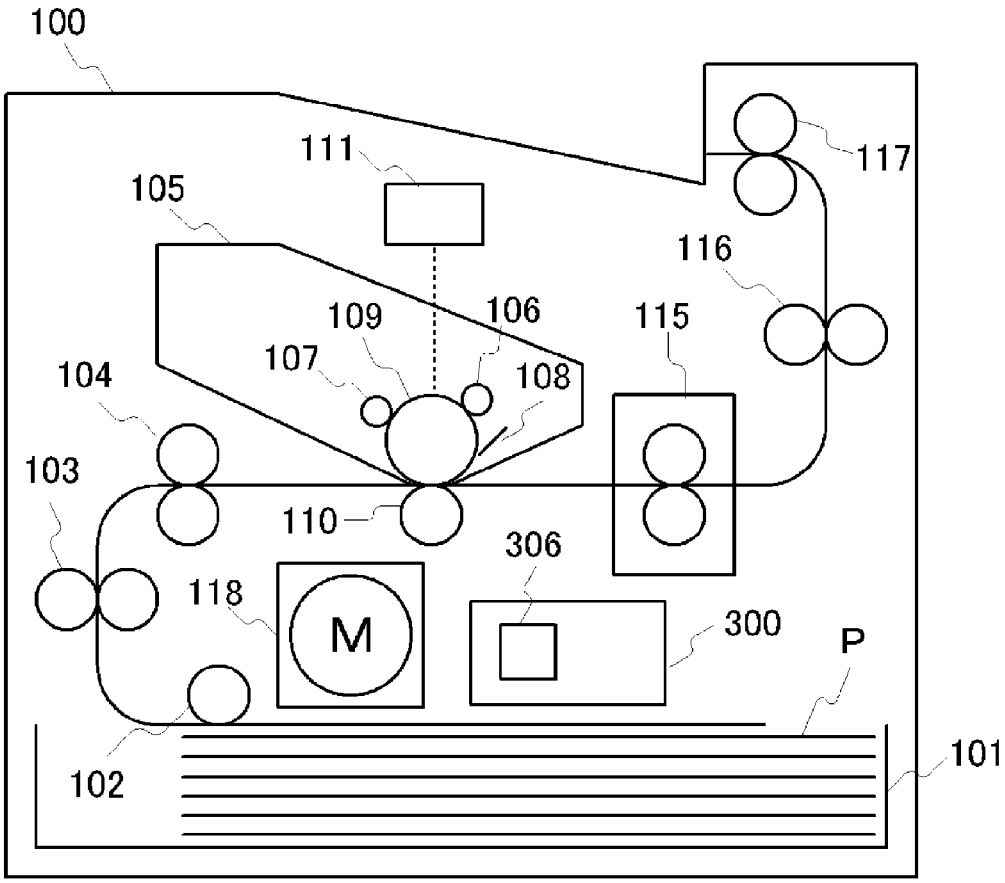
FIG. 1 is a general cross-sectional diagram of an image-forming apparatus relating to an embodiment of the present invention.

FIG. 1 shows an overview of the composition of an image-forming apparatus 100 relating to an embodiment of the present invention. A recording material (hereinafter called "recording paper P") loaded in a paper supply cassette 101 is conveyed to a process cartridge 105 at a prescribed timing, via a pick-up roller 102, a paper feed roller 103 and a paper stop roller 104. The process cartridge 105 is composed in an integrated fashion by a charging means 106, a developing means 107, a cleaning means 108 and a photosensitive drum 109. In the process cartridge 105, a series of steps of an electrophotographic process, which is a commonly known technique, are carried out by laser light emitted from the exposure light means 111, and an unfixed toner image is thereby formed on the photosensitive drum 109. When the unfixed toner image on the photosensitive drum 109 is transferred to the recording paper P by a transferring means 110, the recording paper P is subjected to a heating and pressurization process in the fixing apparatus (image heating apparatus) 115 which acts as a fixing unit, and the unfixed toner image is fixed onto the recording paper P. Thereupon, the paper is discharged to outside the main body of the image-forming apparatus 100 via an intermediate paper discharge roller 116 and a paper discharge roller 117, and the series of printing operations (image forming operations) is finished. The motor 118 applies a drive force to the respective units which include the fixing apparatus 115. Furthermore, the fixing apparatus 115 is driven and controlled by a ceramic heater drive circuit 300 and a CPU 306. In the composition described above, the configuration relating to the formation of an unfixed toner image on the recording paper P is the image forming unit of the present invention.

Figure 2:
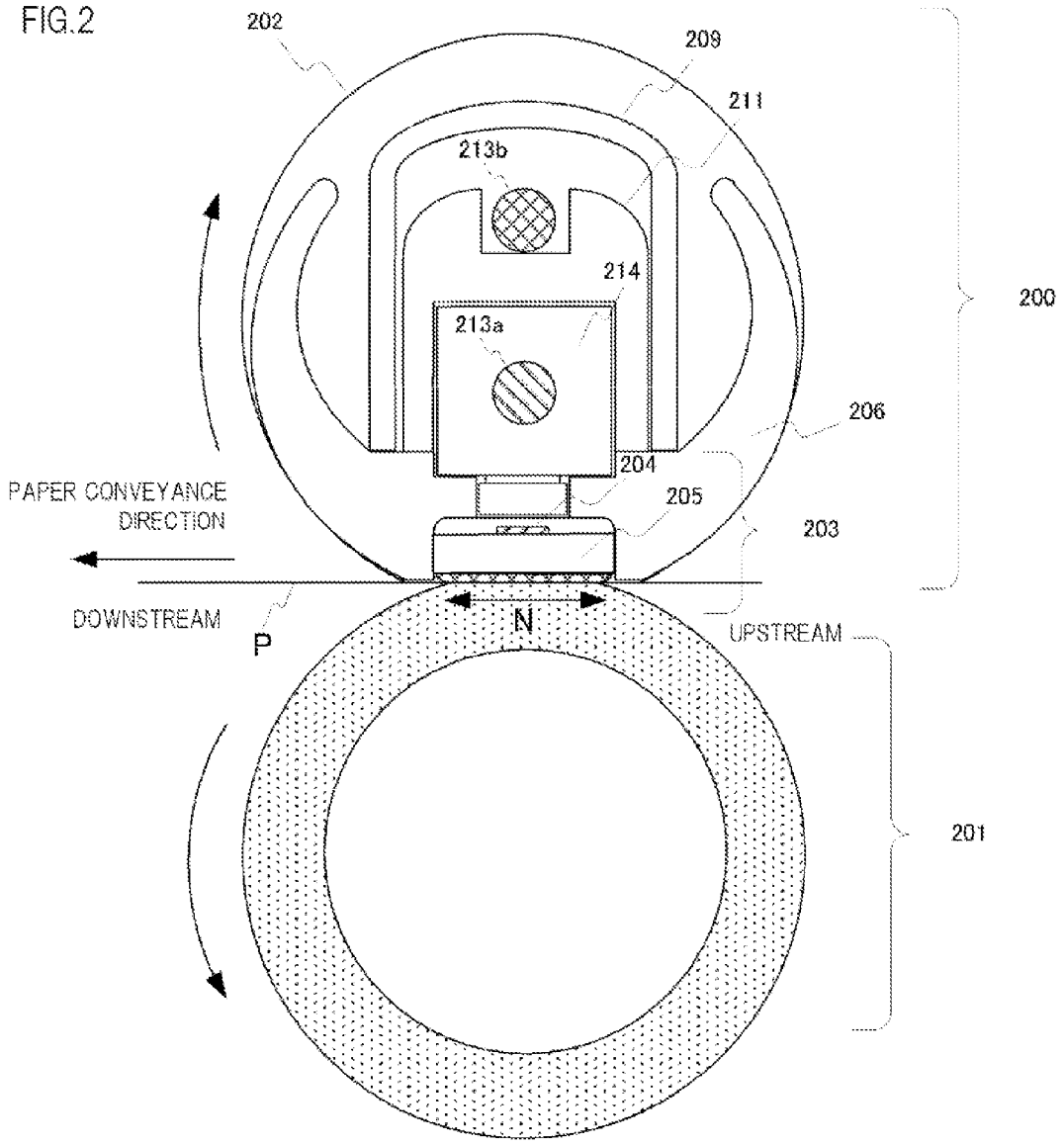
FIG. 2 is a schematic cross-sectional diagram of a fixing apparatus according to the embodiment of the present invention.

FIG. 2 shows an overview of the composition of a fixing apparatus 115 relating to an embodiment of the present invention. The fixing apparatus 115 has a fixing film unit 200 and a pressurizing roller (pressurizing member) 201. In the fixing film unit 200, the ceramic heater (heating body) 203 is pressed against the pressurizing roller 201 by a spring (not illustrated), via a stay 209 and a film guide 206, which are rigid members. The fixing apparatus 115 sandwiches and conveys the recording paper P in a nip section N which is formed between the ceramic heater 203 and the pressurizing roller 201, via an endless (cylindrical) fixing film 202 which rotates about the film guide 206. The heat of the ceramic heater 203 which is heated by supplying power is transmitted to the recording paper P via the fixing film 202, thereby melting the toner image on the recording paper P, and by pressurizing the toner image in the nip section N, the molten toner is fixed onto the recording paper P. Furthermore, overheating protection element units (211, 213*a*, 213*b*, 214) for protecting against overheating are also provided. Both terminals of the overheating protection element 214 are connected to a DC power source 302 by an electric wire 213*a* and an electric wire 213*b*. Furthermore, the overheating protection element 214 is inserted into an overheating protection element holder 211. The pressurizing roller 201 is connected by a gear to the motor 118, and by driving the motor 118, the pressurizing roller 201 and the fixing film 202 rotate in the direction of the arrow in FIG. 2. The composition of the fixing apparatus described here is no more than one example, and other compositions, such as one using a fixing roller, are also possible.

Figure 3:
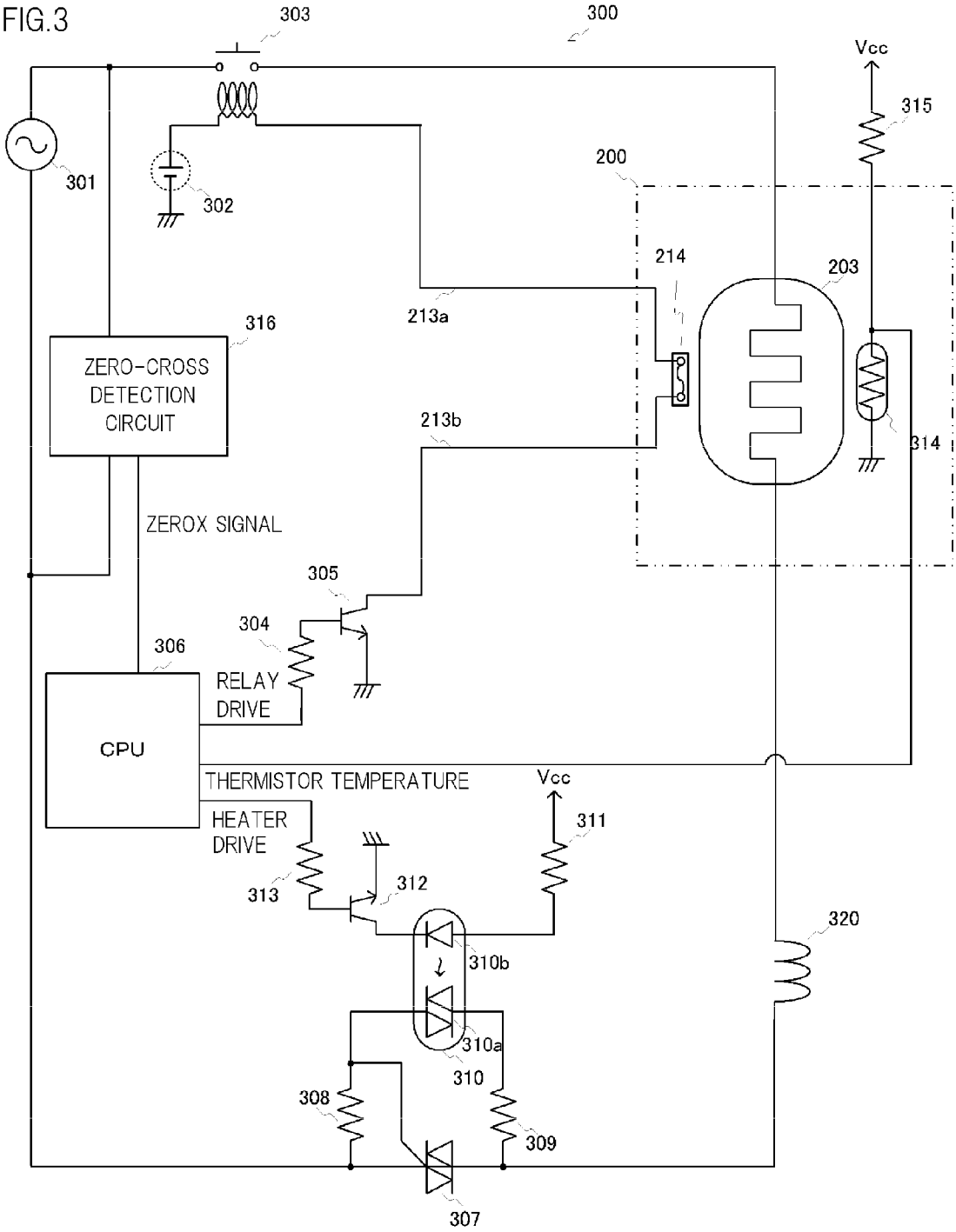
FIG. 3 is a drive circuit diagram of a fixing apparatus according to the embodiment of the present invention.

FIG. 3 shows a ceramic heater drive circuit 300 in an embodiment of the present invention. In FIG. 3, the image-forming apparatus 100 causes a heating resistance (heat generating member) 204 which is formed on a heater substrate 205 of the ceramic heater 203 to generate heat, by supplying an input voltage from a commercial AC power source 301, to the ceramic heater 203, via a relay 303. The heater substrate 205 makes contact with the inner surface of the fixing film 201. The ceramic heater drive circuit 300 is provided in order to independently control the power supply to the ceramic heater 203. By switching on the relay drive signal from the CPU (control unit) 306, via the resistance 304, and thereby switching on the transistor 305, the DC power source 302 is supplied to the drive coil of the relay 303, and the relay 303 assumes a conducting state.

In a zero-cross detection circuit 316, the fact that the input voltage from the commercial AC power source 301 has become equal to or less than a prescribed threshold value is sent to the CPU 306 as a pulse signal (called "ZEROX signal" below). The CPU 306 detects the edges of the pulse of the ZEROX signal and switches conduction of the triac 307 on and off in synchronism with the edges. Accordingly, electric power is supplied to the heat generating resistance 204 (called "heater power supply") below.

The resistances 308, 309 are each bias resistances for the triac 307, and the photo triac coupler 310 is a device for protection between the primary and secondary insulation of the circuit configuration of the image-forming apparatus 100. Triacs 310*a* and 307 are switched on when conduction is switched on in the light-emitting diode 310*b* of the photo triac coupler 310. The resistance 311 is a resistance for limiting the current of the light-emitting diode 310*b*, and the photo triac coupler 310 is switched on and off by the transistor 312. The transistor 312 operates in accordance with a heater drive signal from the CPU 306, via the resistance 313. The temperature detected by the thermistor 314 is detected as a differential voltage in the resistance 315 resulting from change in the resistance value of the thermistor 314 due to the temperature change, and is A/D converted into a digital value which is then input to the CPU 306.

The overheating protection element 214 is disposed on the ceramic heater 203 as one means for preventing an overheated state where the ceramic heater 203 exceeds a predetermined temperature. The overheating protection element 214 is a thermo switch or a temperature fuse, for example.

A choke coil 320 is inserted (connected) in series in the line of the ceramic heater 203 and the commercial AC power source 301, in order to suppress the generation of noise during the supply of power to the heater. The choke coil 320 generally has a structure in which a coil is wound about a ring core or a split core. An inexpensive iron powder cores is commonly used for the core, and a humming noise may occur due to vibration of the core as a result of sudden current variations, for instance, when power is supplied to the heater.

Before describing the control of the heater, a general explanation of heater control will be given. Heater control methods include: wave number control, phase control, and hybrid control which combines wave number control and phase control. Phase control is a method in which power is supplied to a heat generating member provided in a heater at a desired phase angle within one half-wave of a commercial AC power source, and this method is suited to shortening the control cycle and improving responsiveness. On the other hand, wave number control is a method in which the on/off switching of a heat generating member provided in a heater is carried out in half-wave units of the commercial AC power source, and this method is suited to suppressing harmonic current distortions and switching noise. Furthermore, hybrid control is a control method in which one control cycle includes a plurality of half-waves, and a portion of the half-waves are controlled by phase control and the remainder are controlled by wave number control. By means of hybrid control, it is possible to suppress the generation of harmonic currents and switching noise compared to a case where phase control alone is used, and furthermore, the control cycle can be shortened compared to a case where wave number control alone is used. It is common to fix the method to any one of the three control methods described above, in accordance with the voltage of the commercial AC power source and the circumstances relating to the occurrence of flicker.

Figure 4:
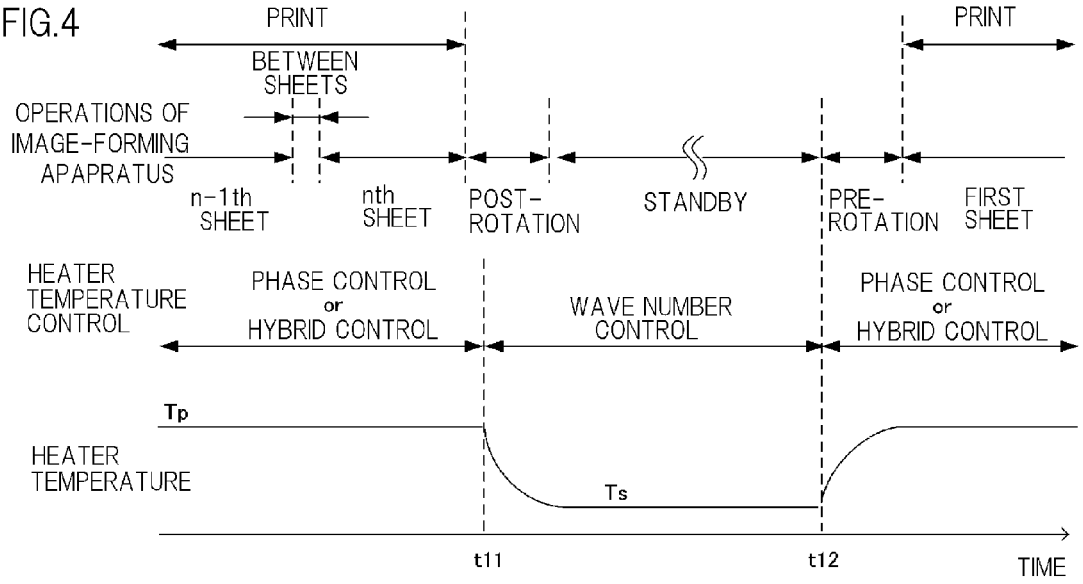
FIG. 4 is a timing chart showing the operation, heater control and heater temperature of an image-forming apparatus.

FIG. 4 is a timing chart which illustrates the relationship between an image forming operation of the image-forming apparatus 100 which repeats a print operation and a standby operation, the control of the ceramic heater 203, and the temperature of the ceramic heater 203 (called the "heater temperature" below). Here, a case is described in which, after n consecutive print operations, a standby operation is performed and then a print operation is performed again. In the present embodiment, during a print operation (during printing) means while an image forming operation is being performed by the image forming unit described above. Furthermore, during standby means when waiting for a print instruction.

During a print operation, heater control is implemented in such a manner that the heater temperature is Tp (for example, 240° C.), by using phase control or hybrid control which is advantageous in terms of the responsiveness of control. In the present example, hybrid control is used, with one control cycle in the print operation of the present example including eight half-waves. During a print operation, the CPU 306 supplies electric power corresponding to the detected temperature (current of wave form corresponding to the detected temperature) from the thermistor 314, every eight half-waves, to the heat generating resistance 204, in such a manner that the heater temperature is maintained at 240° C. To give a more detailed explanation, the power supply to the ceramic heater 203 during a print operation is determined by using proportional and integral control (PI control) or proportional integral and derivative control (PID control), on the basis of the detected temperature from the thermistor 314. The apparatus according to the present example determines the supplied power, using PI control (accurately, the apparatus determines a duty ratio which is the ratio of the on waveform during one control cycle). If the duty ratio is determined using PI control or PID control, then the determined duty ratio takes a different value, depending on the detected temperature.

In this way, during a print operation, the CPU 306 determines the duty ratio by PI control on the basis of the detected temperature from the thermistor 314, and drives the triac 307 in such a manner that current having a hybrid control waveform corresponding to the determined duty ratio flows in the heater.

The heater control is switched to wave number control starting from the timing t11 which is either simultaneous with the end of the print operation, or during a subsequent post-rotation operation. Simultaneously with this, the PI control which determines the duty ratio in accordance with the detected temperature is interrupted, and is switched to power supply based on a fixed duty ratio. More specifically, power is not supplied if the detected temperature is higher than the target temperature (the temperature of 120° C. indicated below in the present example), and control is switched to control for supplying power based on a fixed duty ratio if the detected temperature is lower than the target temperature.

In this way, when the apparatus has finished the post-rotation and has switched to a standby operation, heater control is implemented in such a manner that the heater temperature becomes Ts (for example, 120° C.), by wave number control. By warming the fixing unit during standby, it is possible to shorten the time period from the inputting of a print instruction until the ceramic heater 203 rises to a temperature that enables fixing. Consequently, it is possible to shorten the first print out time (FPOT), which is the amount of time required to output the first sheet of recording material, after issuing a print instruction. When a print instruction is input at timing t12 and a new print operation is started after pre-rotation, starting at timing t12, then the duty ratio is determined again by PI control, and the waveform of the current flowing in the ceramic heater 203 is set to a hybrid control waveform. Consequently, heater control is started in such a manner that the heater temperature becomes Tp. During standby, the driving of the pressurizing roller 201 is halted in order to reduce the power consumption.

In this way, in the present embodiment, the CPU (control unit) performs power supply to the ceramic heater 203 by control including phase control, while the apparatus is printing, and performs power supply to the ceramic heater 203 by wave number control, during standby while waiting for a print instruction. Wave number control makes it possible to reduce the humming noise produced by the choke coil. Therefore, it is possible to suppress the occurrence of a humming noise of the coil during standby, while ensuring the responsiveness of heater control during printing.

Next, heater control using wave number control during standby will be described. When temperature control is applied to the ceramic heater 203 during standby, using wave number control in which a prescribed number of half-waves of alternating current are taken as one control cycle, then it is desirable for the one control cycle to be no less than 34 half-waves. In the present embodiment, one control cycle is taken to include 40 half-waves of alternating current which is input from the commercial AC power source 301. A control example is illustrated here in which, the input power ratio to the heat generating resistance 204 is set to 5% (=2/40) by supplying 100% power (described below) in two half-waves of a specific phase in 40 half-waves (indicated by the numbers of the half-waves shown in FIG. 5). In the present example, the number of half waves of one control cycle during standby is greater than the number of half waves of one control cycle during printing. More specifically, one control cycle (40 half-waves) during standby is five times the length of one control cycle (8 half-waves) during printing. Also, during standby, similarly to during printing, power is supplied to the ceramic heater 203 in such a manner that the detected temperature of the thermistor 314 is kept at the target temperature of Ts (120° C.), but the power duty ratio is uniform, regardless of the detected temperature. In other words, the duty ratio used during standby is fixed to a duty ratio of power that is supplied to the heater when the detected temperature is lower than the target temperature Ts (120° C.), rather than a duty ratio determined by using PI control or PID control (a duty ratio in accordance with the detected temperature). In the present example, the duty ratio is fixed to 5%. Moreover, the waveform of the current flowing to the ceramic heater 203 during standby is a wave number control waveform, but the waveform of the current flowing in the ceramic heater 203 is of one type (a waveform which is on in specific phases during one control cycle (the No. 1 half-wave and the No. 6 half-wave in FIG. 5A)).

Figure 5A:
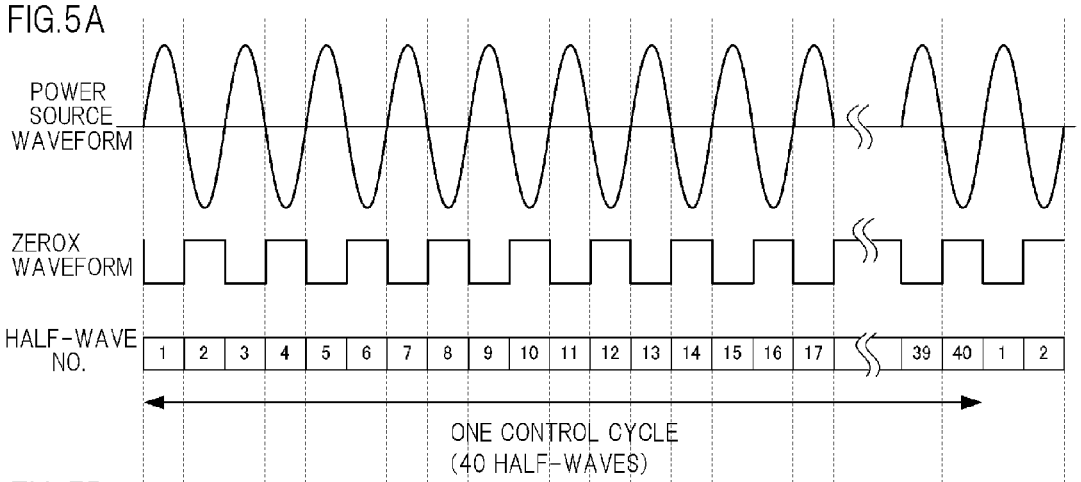
FIGS. 5A and 5B are illustrative diagrams of heater control according to a first embodiment of the present invention.

FIG. 5A shows half-wave numbers (called "half-wave no." below) which assign numbers to each half-wave in the power source waveform from the commercial AC power source 301, the ZEROX signal, and one control cycle of heater control. Furthermore, FIG. 5B shows the waveform of the heater drive signal, and indicates the current supplied to the heat generating resistance 204 (called the "heater current" below) in accordance with this waveform.

Figure 5B:
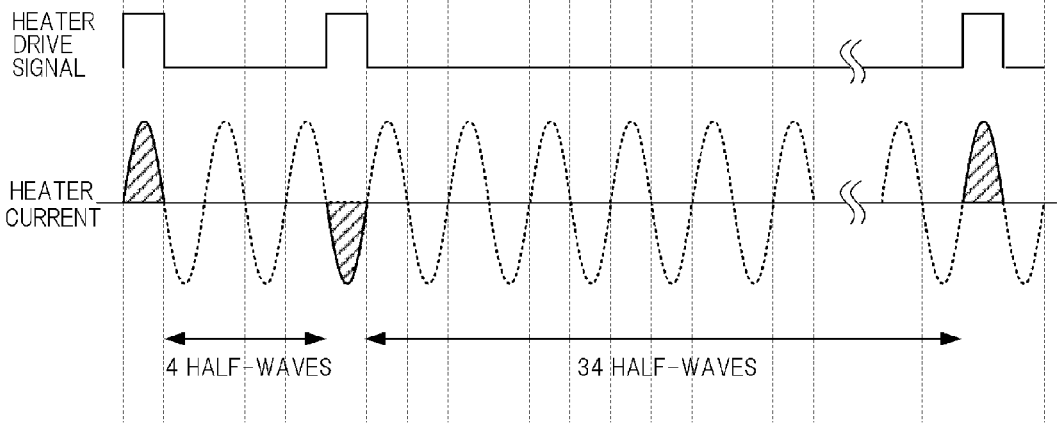

In FIG. 5B, wave number control is used to switch the current on and off in units of half-waves of the commercial AC power source 301. When supplying power to the heat generating resistance 204, the heater drive signal (ON signal) turns on with the edge of the ZEROX signal (called the "zero cross point" below), and in the portion indicated by the hatching in FIG. 5B, a heater current flows and power is supplied to the heat generating resistance 204. In this half-wave, power is supplied at 100% (for example, half-wave No. 1). On the other hand, when heater power supply is not performed, the heater drive signal is kept off, while the power supply in that half-wave section is set to 0% (for example, half-wave No. 2). To give an example of this wave number control, in the 40 half-waves included in one control cycle, power is supplied at 100%, 0%, 0%, 0%, 0%, 100%, . . . , 0%, 0% in each respective half-wave, whereby an average input power ratio of 5% is achieved. Furthermore, a pattern is adopted in which the positive half-waves and the negative half-waves in one control cycle are input in the same number and therefore have a positive/negative symmetry.

In the present embodiment, the interval between adjacent half-waves which perform heater power supply is four half-waves. The reason for this is described here with reference to FIG. 6 and FIG. 7.

The table in FIG. 6 is one example showing a relationship between the power supply pattern and a Plt value which is a numerical value that gives a quantitative representation of the long-term flicker, when power is supplied with an input power ratio of 5% to the heat generating resistance 204 (called the "heater input power ratio" below) by using wave number control. The Plt value varies with the conditions such as the heater input power ratio, the resistance value of the heat generating resistance 204, the commercial AC voltage, the commercial AC frequency, and so on, and the smaller the value, the better the situation. In general, greater voltage fluctuation per unit time is generated, the higher the commercial AC voltage value or the commercial AC frequency, or the greater the heater input power ratio, or the smaller the resistance of the heat generating resistance 204, and therefore the Plt value tends to become worse in such situations.

In the present embodiment, an example is given in which the input power ratio to the heat generating resistance 204 is 5%, the commercial AC voltage is 230V, and the commercial AC frequency is 50 Hz. Here, the variation in the Plt value with the resistance value of the heat generating resistance 204 will be described with reference to FIGS. 6A and 6B.

FIGS. 6A and 6B show, in the left-hand column, the half-wave No. where power is supplied at 100%, and in the right-hand column, the corresponding Plt value, in cases where the resistance value of the heat generating resistance 204 is 44Ω and 52Ω, respectively. In order to make the description of the power supply pattern easier to understand, the half-wave No. 1 is always taken to be at 100% power supply. From a comparison of FIG. 6A and FIG. 6B, it can be seen that the Plt value wholly deteriorates, when the value of the heat generating resistance 204 is a relatively low value of 44 Ω.

Figure 7A:
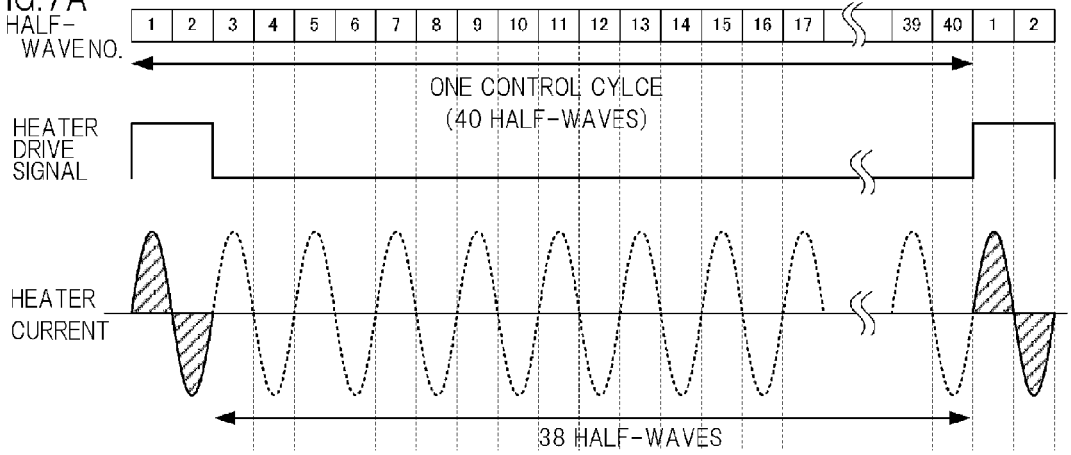
FIGS. 7A and 7*b* are illustrative diagrams of one example of heater control.
Figure 7B:
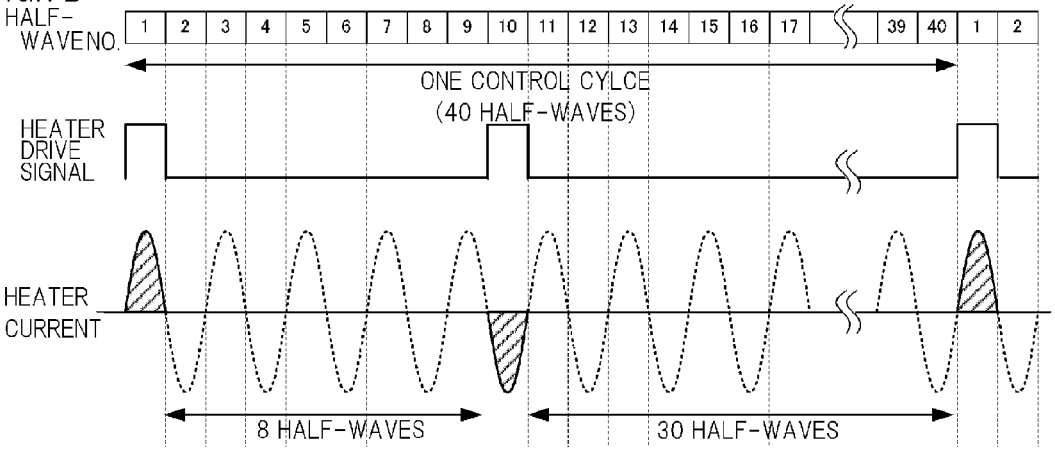

Furthermore, FIG. 7A shows the heater drive signal and the waveform of the heater current in a case where the half-wave No. 2 is set to 100% power supply in the table in FIGS. 6A and 6B. Furthermore, FIG. 7B shows the heater drive signal and the waveform of the heater current in a case where the half-wave No. 10 is set to 100% power supply in the table in FIGS. 6A and 6B. In both of these cases, by supplying power at 100% in a prescribed two half-waves, when the number of half-waves in one control cycle is set to 40, the input power ratio to the heat generating resistance 204 is set to 5%.

In both of FIG. 6A and FIG. 6B, it can be seen that the Pit value is lowest in half-wave No. 6, in other words, when an interval of four half-waves is left between adjacent half-waves in which heater power supply is performed. This corresponds to the half-wave shown in FIG. 5. Furthermore, it can be seen that in half-wave No. 2 and half-wave No. 4 onwards, there is a large difference in the Plt value. Furthermore, if 100% power is supplied in half-wave No. 2, in other words, if the adjacent half-waves in which heater power is supplied are consecutive half-waves, then the Plt value becomes extremely high. The reason for this is that, when the flicker is measured quantitatively, the effective voltage in the measurement time range compliant with IEC is measured continuously, and the variation in this effective voltage is converted into a numerical value, and therefore the time range during which the effective voltage varies becomes long if the adjacent half-waves are consecutive. Consequently, in order to improve flicker, it is necessary to leave an interval of no less than two half-waves between adjacent half-waves in which heater power supply is performed.

According to the control of the present embodiment, two beneficial effects are obtained. One effect is that by switching to wave number control during standby, from phase control or hybrid control which is effective for reducing temperature ripples in the heater during printing, it is possible to prevent a humming noise in the coil, by an inexpensive composition, during standby in which there is no operating noise of the motors, or rubbing sound of the recording paper. A further effect is that flicker is improved by leaving an interval of no less than two half-waves between adjacent half-waves in the wave number control during standby.

An example of control was given in the explanation of the present embodiment in which one control cycle is set to 40 half-waves, heater power supply is performed at four half-wave intervals, and the input power ratio to the heat generating resistance 204 is 5%. However, since the flicker when using wave number control can be improved, provided that the interval between adjacent half-waves in which power is supplied to the heat generating resistance 204 is no less than two half-waves, then the input power ratio to the heat generating resistance 204 is not limited to 5%. Furthermore, the number of half-waves in one control cycle is not limited to 40 half cycles.

In the present embodiment, a case is described in which the commercial AC voltage is 230V and the commercial AC frequency is 50 Hz. Although the Plt value increases or decreases at other values of the commercial AC voltage and commercial AC frequency, this only involves a variation in the absolute value of the Plt value, and therefore similar beneficial effects can be obtained. Moreover, an example has been given in which the value of the heat generating resistance 204 was 44Ω and 52Ω, but a similar description is applicable to other resistance values of the heat generating resistance. It should be noted that, depending on the value of the heat generating resistance, there are also cases where it is desirable to take account of the conditions relating to one control cycle which are described in the second embodiment. If the heat generating resistance value is extremely small, then there are concerns that it will not be possible to suppress the occurrence of flicker. For instance, if the commercial AC voltage is 230 V and the value of the heat generating resistance is lower than 25Ω, then the effects of the voltage variation cannot be ignored, and hence there is a concern in that the expected effects cannot be obtained. In this way, in the present embodiment, especially beneficial effects are obtained in cases where the invention is implemented in the range of generally employed heat generating resistance values.

Second Embodiment

An image-forming apparatus relating to a second embodiment of the present invention is now described with reference to FIG. 8 to FIG. 12. The present embodiment describes desirable conditions of one control cycle for satisfying flicker standards in wave number control during standby. The composition of the fixing apparatus 115 and the composition of the ceramic heater drive circuit (reference numerals) are the same as in the first embodiment, and therefore further description thereof is omitted here.

According to the international standard IEC/EN 61000-3-3, the upper limit value of the Plt value is designated as 0.65. Furthermore, since the flicker depends greatly on the sensitivity of the viewer's eyes, this also depends on individual differences, the differences between lamps, fluorescent lights and other appliances, and environmental differences. Consequently, it is necessary to set one control cycle by taking account of the flicker specifications described above and variable factors.

Next, one example of a method for setting one control cycle in wave number control will be described. In order to obtain a desirable heater input power ratio, while maintaining the positive/negative symmetry in the half-wave units, a setting method such as the following may be adopted. If it is desired to obtain an input power ratio of 5% to the heat generating resistance 204, then if one control cycle is set to include 40 half-waves, it is possible to achieve the desired input power ratio provided that heater power supply is performed in two half-waves as described in the first embodiment. On the other hand, if one control cycle is set to include 80 half-waves, then since the control cycle is two times greater, the heater power supply may also correspond to two times the number of half-waves, namely, four half-waves. Similarly, if it is wished to achieve an input power ratio of 6% to the heat generating resistance of 204, then if one control cycle is 34 half-waves and power supply is performed in two half-waves, then a ratio of 5.9% is achieved, and if one control cycle is 66 half-waves and power supply is performed in four half-waves, then a ratio of 6.1% is achieved.

The relationship between the input power ratio to the heat generating resistance 204, the number of half-waves in one control cycle, and the number of half-waves in which heater power supply is performed is determined in view of the following points. Firstly, the input power ratio required for the desired heater temperature is derived from the heat generating resistance value and the commercial AC voltage value. Generally, the heater control switches on when the temperature falls below a threshold value provided near to the desired heater temperature, and switches off when the temperature rises above this threshold value. Consequently, if the input power ratio is too great, then the heater temperature ripples become great, and conversely, if the input power ratio is too small, then the heater is less liable to become warm, and therefore it is necessary to supply power to the heater for a long time. In view of these factors, an optimal input power ratio is determined, and the number of half-waves in one control cycle and the number of half-waves during which power is to be supplied are determined in accordance with the commercial AC frequency, so as to achieve the determined input power ratio. The longer the control cycle, the more accurately the input power ratio can be set. However, since the heater control is generally carried out in one control cycle, then it is necessary to wait for one control cycle to end, when transferring to a different input power ratio or when transferring to a different temperature control method. Consequently, it is desirable to make the control cycle as short as possible.

Next, the fact that it is desirable to set one control cycle to include no less than 34 half-waves, when carrying out temperature control by wave number control in the ceramic heater 203 during standby, will be described with reference to FIG. 8 to FIG. 10.

The table in FIG. 8 shows the relationship between the Plt value and the number of half-waves in one control cycle of the heater control relating to the present embodiment. The left-hand column shows the number of half-waves in one control cycle, and the right-hand column shows the amount of change in the Plt value in each control cycle, with reference to the Plt value when one control cycle is taken to include 34 half-waves. An amount of change of the Plt value which is indicated as a positive value in the right-hand column of the table represents a deterioration, and a negative value represents an improvement. Furthermore, the numerical values vary depending on conditions, such as the input power ratio to the heat generating resistance 204, the value of the heat generating resistance 204, the commercial AC voltage value, and the commercial AC frequency. The effects of these parameters were described in relation to the first embodiment, and therefore explanation thereof is omitted here.

Figure 12:
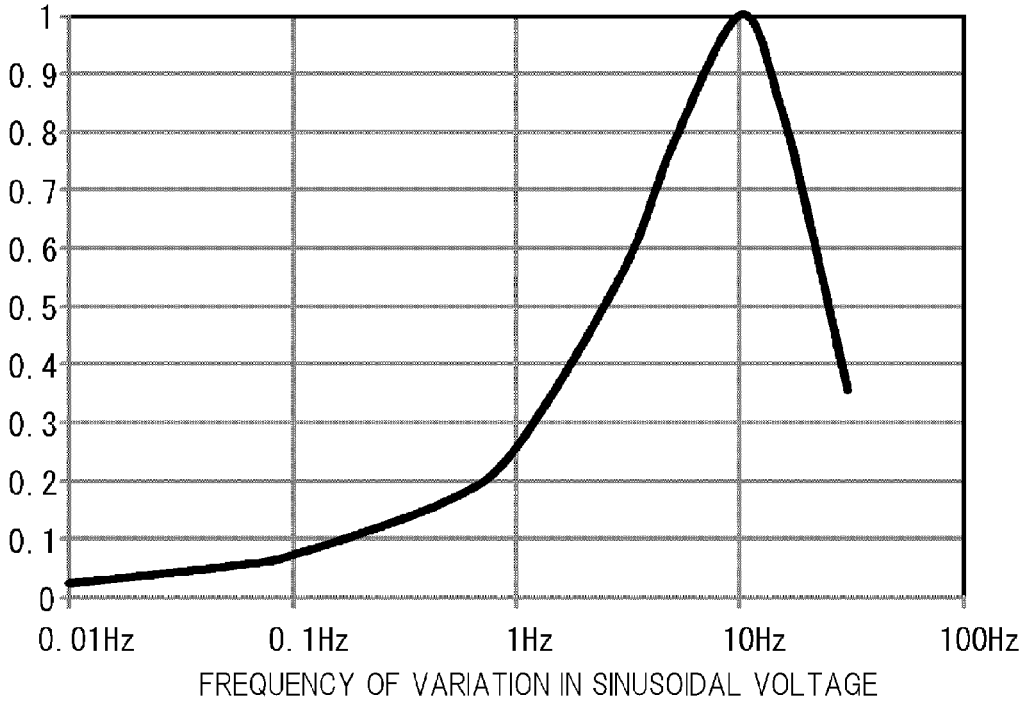
FIG. 12 is a flicker visibility curve in which the sensitivity of flicker corresponding to the frequency is expressed as a numerical value.

FIG. 12 is a flicker visibility curve which is used generally as a measure for determining the level of flicker. The flicker sensitivity corresponding to respective frequencies is expressed as a number, taking the maximum sensitivity at a frequency of 10 Hz to have a value of 1. It can be seen that the voltage variation in the 10 Hz frequency component produces the highest flicker visibility and the worst flicker effect. If the commercial AC frequency is 50 Hz, then for example, the frequency is 2.9 Hz if one control cycle includes 34 half-waves, whereas the frequency is 3.8 Hz if one control cycle includes 26 half-waves. These frequencies are calculated by the following equation.

Frequency in one control cycle=(commercial AC frequency×2)/number of half-waves in one control cycle Since the frequency is 10 Hz when one control cycle includes 10 half-waves, then the flicker is worst in this case.

From FIG. 8 and FIG. 12, it can be seen that, in the region where one control cycle includes 10 or more half-waves, the smaller the number of half-waves in one control cycle, the nearer to 10 Hz the frequency component of the voltage variation produced by heater power supply, and therefore the worse the Plt value. Consequently, even if an interval of no less than two half-waves is left between adjacent half-waves when power is supplied to the heater as described in the first embodiment, if one control cycle is shorter than 40 half-waves, then there may be cases where a sufficient effect in improving the Plt value is not obtained.

Figure 9A:
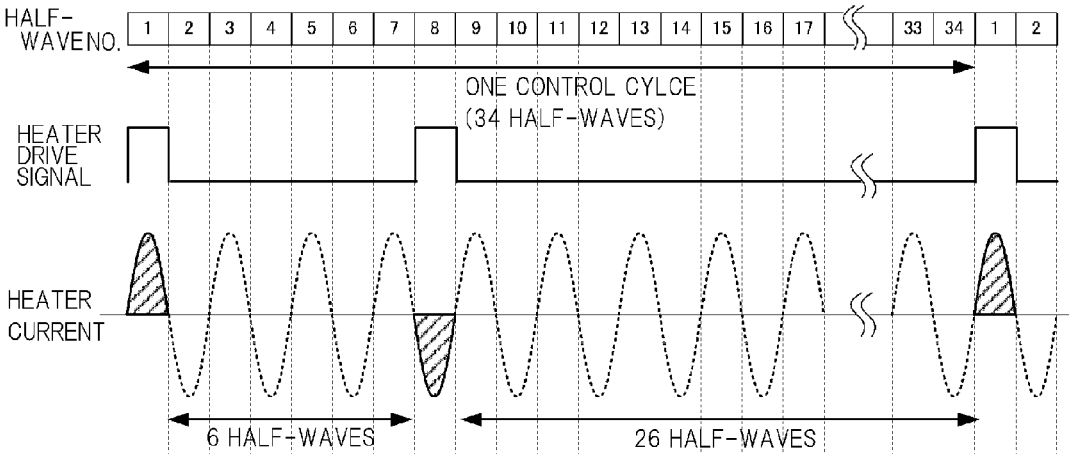
FIGS. 9A and 9B are illustrative diagrams of heater control according to a second embodiment of the present invention.
Figure 9B:
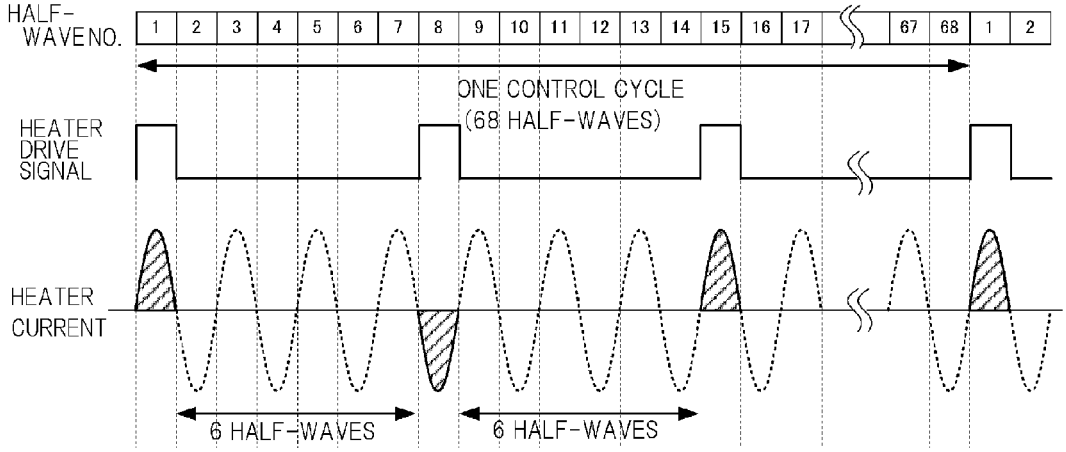

FIGS. 9A and 9B are diagrams showing one example of heater control in two different control cycles. FIG. 9A shows a state where 100% power supply is fixed to two half-waves when one control cycle includes 34 half-waves, and FIG. 9B shows a state where 100% power supply is fixed to four half-waves when one control cycle includes 68 half-waves; in both of these cases, the input power ratio to the heat generating resistance 204 is 5.9%.

Furthermore, the tables in FIGS. 10A and 10B are examples showing the relationship between a power supply pattern and the Plt value in two different control cycles shown in FIGS. 9A and 9B. In both FIGS. 10A and 10B, the left-hand column indicates the half-wave No. where 100% power is supplied, and the right-hand column indicates the corresponding Plt value. In order to make the description of the power supply pattern easier to understand, the half-wave No. 1 is always taken to be at 100% power supply.

Comparing the tables in FIGS. 10A and 10B which are created on the basis of the same input power ratio 5.9%, it can be seen that in the case where one control cycle includes a greater number of half-waves, namely, 68 half-waves, the Plt value is lower, even though the number of half-waves in which power is supplied to the heater is greater. Compared to the international standard value of 0.65, the Plt value is as indicated below. If one control cycle includes 68 half-waves, then the standard is satisfied for all half-wave numbers, whereas if one control cycle includes 34 half-waves, then the standard is only met in cases where 100% power is supplied in half-wave No. 2. However, No. 2 means a case where the interval between adjacent half-waves in which power is supplied to the heater is consecutive, and as described in relation to the first embodiment, it is possible to set up the control in such a manner that the standard is satisfied, provided that a power supply pattern is used in which an interval of two or more half-waves is left.

Furthermore, the table in FIG. 11 is premised on the fact that when one control cycle includes 32 half-waves and power supply is performed in two half-waves, the input power ratio to the heat generating resistance 204 is the same value of 5.9% as that in the control cycle of 34 half-waves shown in the table in FIG. 10A. In order to set the input power ratio to the heat generating resistance 204 to 5.9%, the Pit value measured with a control cycle of 32 half-waves is multiplied by 1.06 (=34/32) to calculate the relationship between the power supply pattern and the Plt value.

Comparing the tables in FIG. 10A and FIG. 11, if one control cycle includes 34 half-waves, then as stated above, the Plt value only exceeds the standard in cases where 100% power is supplied in half-wave No. 2. If one control cycle includes 32 half-waves, then the Plt value exceeds the standard when 100% power is supplied in half-wave No. 12 in addition to No. 2.

Consequently, it can be seen that the Plt value is made to be 0.65 or lower by leaving an interval of no less than two half-waves between adjacent half-waves in which power is supplied to the heater, and by setting one control cycle to include no less than 34 half-waves.

In the description of the present embodiment, an example is given in which the resistance value of the heat generating resistance 204 is 44Ω, the commercial AC voltage is 230V, and the commercial AC frequency is 50 Hz. However, if the value of the heat generating resistance 204 is sufficiently high, then the parameters are not limited to the conditions described above, provided that the standard for the Plt value can be satisfied even if there are consecutive half-waves in which 100% power is supplied. Furthermore, if 100% power supply is necessary in four or more half-waves, then it is possible to satisfy the standard for the Plt value by adjusting the conditions relating to one control cycle, and the interval between adjacent half-waves, from the perspective described above.

From the foregoing, it can be regarded that, provided that one control cycle includes 34 or more half-waves, the standard for the Plt value can be satisfied in a wide range of conditions. As described in relation to the first embodiment, it is possible to obtain similar beneficial effects at other values of the commercial AC voltage and the commercial AC frequency. Furthermore, there are cases where, depending on the resistance value of the heat generating resistance 204, it is desirable to leave an interval of no less than two half-waves between adjacent half-waves in which power is supplied to the heater as described in the first embodiment. As mentioned in the first embodiment, if the heat generating resistance value is very small indeed, then there may be cases where the occurrence of flicker cannot be suppressed, and therefore particularly good effects are obtained in cases where control is implemented in the effective range of the heat generating resistance values.

Third Embodiment

Table 1 indicated below is one example showing a relationship between the number of consecutive switch-on operations of the heater, and the Pit value which is a numerical value giving a quantitative representation of the long-term flicker, in a case where power is supplied by the waveform shown in FIG. 5B. For example, if the number of consecutive switch-on operations of the heater is two, then the Plt value is 0.429 if the waveform in FIG. 5B is supplied consecutively in two control cycles.

TABLE 1

| Heater switch-on consecutive number | Plt value |
|---|---|
| 3 | 0.433 |
| 2 | 0.429 |
| 1 | 0.407 |

The Plt value varies with the conditions such as the input power ratio to the ceramic heater 203, the resistance value of the heat generating resistance 204, the commercial AC voltage, the commercial AC frequency, and so on, and the smaller the value, the better the situation. In general, greater voltage fluctuation per unit time is generated, the higher the commercial AC voltage value or the commercial AC frequency, or the greater the input power ratio to the ceramic heater 203 (duty ratio), or the smaller the resistance value of the heat generating resistance 204, and therefore the Plt value tends to become worse in such situations.

In the present embodiment, an example is given in which the input power ratio to the heat generating resistance 204 is 5%, the commercial AC voltage is 230V, and the commercial AC frequency is 50 Hz. Here, it can be seen that the Plt value also decreases in proportion to the decrease in the number of consecutive switch-on operations of the heater. As described above, although it is possible to improve flicker, the smaller the number of consecutive switch-on operations of the heater, if the number of heater switch-on operations is too few, then the input power to the heat generating resistance 204 becomes smaller, and it is difficult to keep the heater temperature at the target temperature of Ts. Consequently, the number of consecutive operations should be limited to a suitable number in accordance with the commercial AC power source and the composition of the heater drive circuit. In the present embodiment, the limit (maximum limit) for the number of consecutive heater switch-on operations is set previously to two. The waveform shown in FIG. 5B is an effective waveform for suppressing flicker while still being a wave number control waveform. However, if power is supplied continuously using this waveform, then the flicker suppressing effect is reduced. Therefore, the deterioration of flicker is suppressed by limiting the number of consecutive heater switch-on operations to two consecutive control cycles. Since the number of consecutive heater switch-on operations is limited to two consecutive control cycles, there may be cases where the temperature of the ceramic heater 203 does not reach the target temperature Ts (120° C.), but this control gives priority to suppressing flicker, rather than maintaining the ceramic heater 203 at the target temperature. During standby, the fixing unit needs only be warmed to a certain extent, rather than carrying out a fixing process, and therefore it is not necessary to keep the ceramic heater 203 strictly at the target temperature.

Next, temperature control during standby according to the present embodiment will be described with reference to the flowchart in FIG. 13. The temperature control during standby according to the present embodiment is characterized in that heater switch-off control is carried out forcibly after heater switch-on control has been carried out a prescribed number of times consecutively, even in cases where the detected temperature from the thermistor 314 which operates as a detection unit has not reached the prescribed target temperature.

Firstly, when temperature control is started, the CPU 306 clears the switch-on number K which is the number of times a heater switch-on operation is performed (S601). The CPU 306 then determines whether or not the detected temperature from the thermistor 314 is lower than the target temperature Ts (S602). If the detected temperature is greater than the target temperature Ts (No at S602), then the CPU 306 implements heater switch-off control (S603), and clears the switch-on number K (S604).

On the other hand, if the detected temperature is lower than the target temperature Ts (Yes at S602), then it is subsequently determined whether or not the switch-on number K is less than the consecutive execution limit number Max (which is 2 in the present embodiment) (S605). If the switch-on number K is less than the consecutive execution limit number Max (Yes at S605), then the CPU 306 implements heater switch-on control (S606), and increments the switch-on number K by one (S607). If it is determined that the switch-on number K is equal to or greater than the consecutive execution limit number Max (No at S605), then the CPU 306 implements heater switch-off control (S603), and clears the switch-on number K (S604).

Subsequently, the CPU 306 determines whether or not a temperature adjustment halt command has been received (S608). If a temperature adjustment halt command has not been received (No at S608), then the procedure returns to S602, and the standby temperature control is continued. If a temperature adjustment halt command has been received (Yes at S608), then the CPU 306 terminates the standby temperature control.

Figure 13:
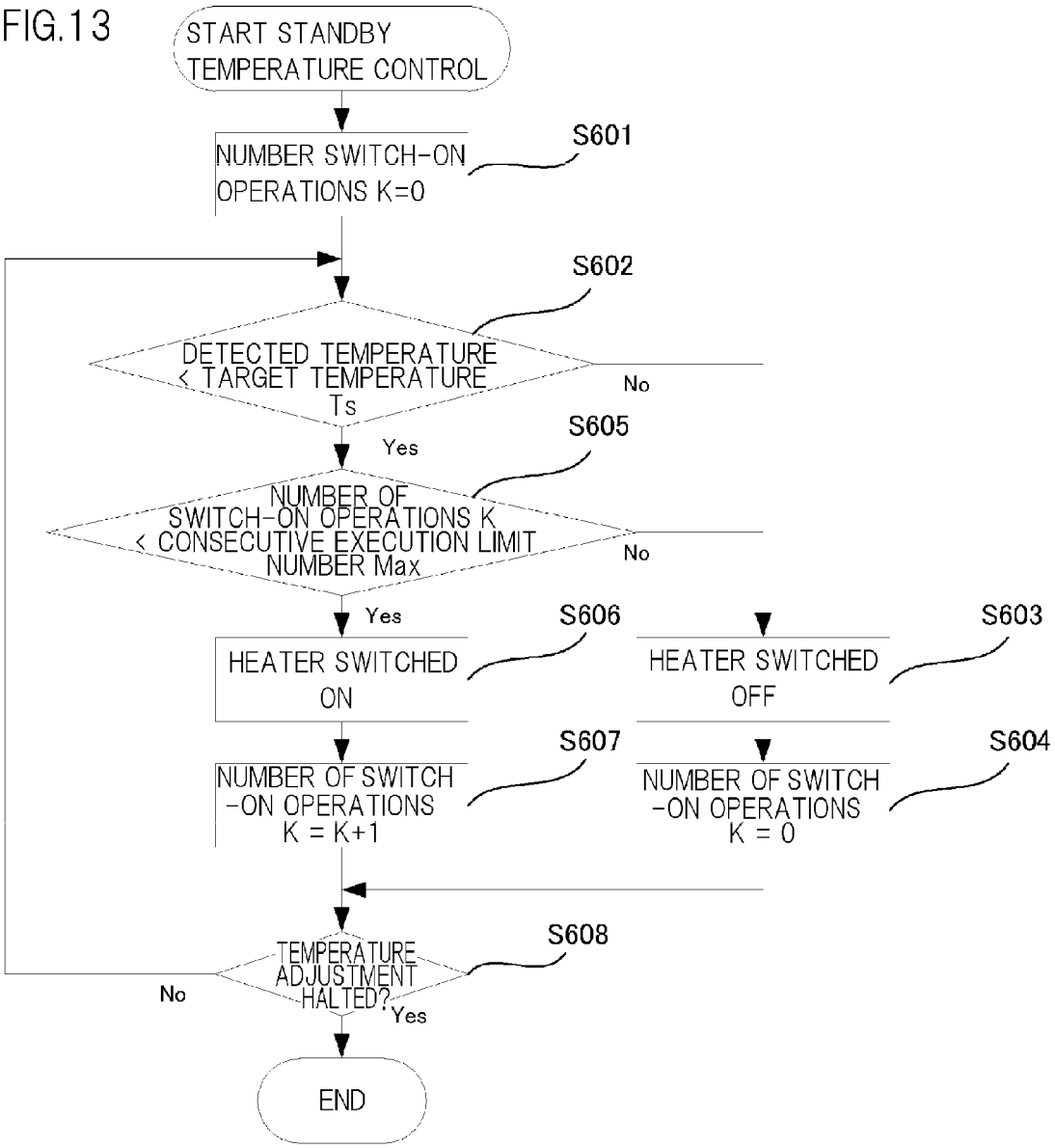
FIG. 13 is a flowchart of temperature control during standby according to a third embodiment.
Figure 14:
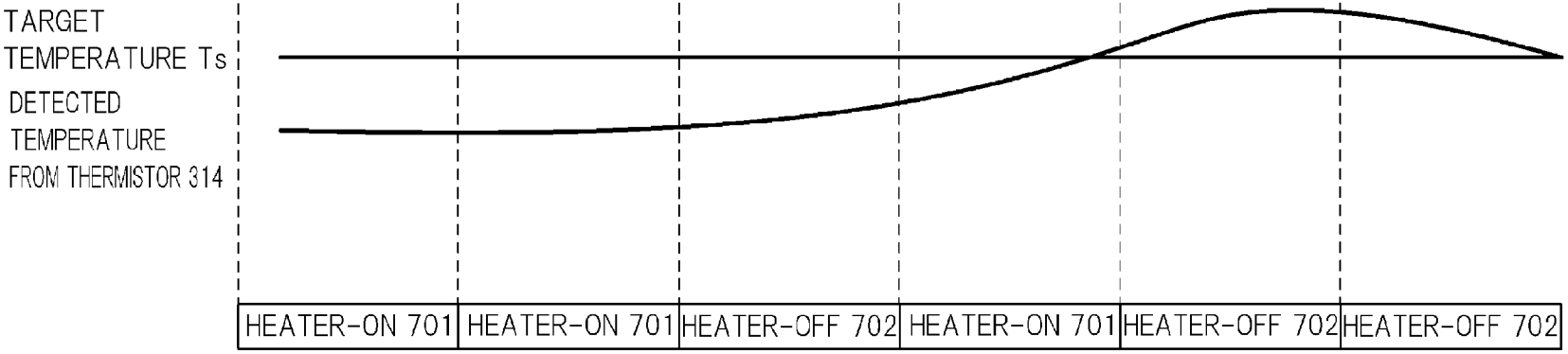
FIG. 14 is a diagram of the relationship between temperature control and the heater temperature during standby according to the third embodiment.

FIG. 14 shows one example of the relationship between the target temperature Ts, the detected temperature which is detected by the thermistor 314, which forms a detection unit, and the heater control, in the case of the temperature control during standby which is described in FIG. 13. In the heater switch-on operation 701 in FIG. 14, heater control is implemented to achieve an input power ratio of 5% with a control cycle of 40 half-waves, as illustrated in FIG. 5B. In other words, in the heater switch-on operation 701, wave number control is implemented using a waveform in which half-waves that switch on power supply to the heat generating resistance 204 are included in specific phases, from a commercial AC power source. In the heater switch-off operation 702, the heater drive signal is kept off for 40 half-waves which form one control cycle, and hence the input power ratio is set to 0%. More specifically, in the heater switch-off operation 702, the power supply to the heat generating resistance 204 from the commercial AC power source is switched off for a period equal to one control cycle (40 half-waves) of the heater switch-on operation 701.

In temperature control during standby, when the detected temperature which is detected by the thermistor 314 reaches the target temperature Ts, then a heater switch-off operation is carried out (P707, P708). On the other hand, if the detected temperature which is detected by the thermistor 314 has not reached the target temperature Ts, then a heater switch-on operation 701 is carried out (P703, P704, P706). In the present embodiment, even if the temperature detected by the thermistor 314 has not reached the target temperature Ts, a heater switch-on operation is not carried out three times consecutively, and a heater switch-off operation is implemented (P705).

By the control according to the present embodiment, a beneficial effect is obtained in that flicker during standby is improved, while suppressing a humming noise in the choke coil. In the description of the present embodiment, an example is given in relation to control when a heater switch-on operation can be performed up to two times consecutively, but the limit number (maximum number) of the consecutive execution limit number (maximum limit number) for heater switch-on operations can be changed in accordance with the conditions, such as the commercial AC voltage or the composition of the commercial AC frequency, and is not limited to two times only.

A description of control in a third embodiment has been given in which, as shown in FIG. 5B, one control cycle includes 40 half-waves, an interval of four half-waves is left between adjacent half-waves in which power supply is switched on, and hence the power input ratio to the heat generating resistance 204 is 5%. However, the invention is not limited to this and flicker is not liable to occur when using wave number control, provided that an interval of no less than two half-waves is left between adjacent half-waves in which the power supply is switched on. The reason for this is that, when the flicker is measured quantitatively, the effective voltage in the measurement time range compliant with IEC is measured continuously, and the variation in this effective voltage is converted into a numerical value, and therefore the time range during which the effective voltage varies becomes long if the adjacent half-waves in which power supply is switched on are consecutive. Consequently, in order to improve flicker, it is necessary to include no less than 34 half-waves in one control cycle and to leave an interval of no less than two half-waves between adjacent half-waves in which heater power supply is performed.

In the third embodiment, the heater switch-on consecutive execution limit number is the number of times that power supply (heater switch-on) of one control cycle is carried out. In the first embodiment, the heater switch-on consecutive execution limit number is two times, and therefore after performing heater switch-on during two control cycles (a time period corresponding to two control cycles), a heater switch-off operation is performed for a period equal to one control cycle, even if the target temperature has not been reached. The heater switch-on consecutive execution limit number is not limited to two times.

Fourth Embodiment

As described in relation to the third embodiment, the Plt value becomes worse, the higher the commercial AC voltage value and the commercial AC frequency, the greater the heater input power ratio, or the smaller the resistance value of the heat generating resistance 204. Therefore, the optimal heater switch-on consecutive execution limit number differs depending on the conditions of the commercial AC power source. Therefore, in the present embodiment, a method is explained in which the commercial AC voltage and the commercial AC frequency are detected, and by switching the heater switch-on consecutive execution limit number in accordance with the detected voltage and frequency, optimal heater control is carried out in accordance with the conditions of the commercial AC power source. The composition which is similar to the third embodiment is labelled with the same reference numerals and description thereof is omitted here.

Figure 15:
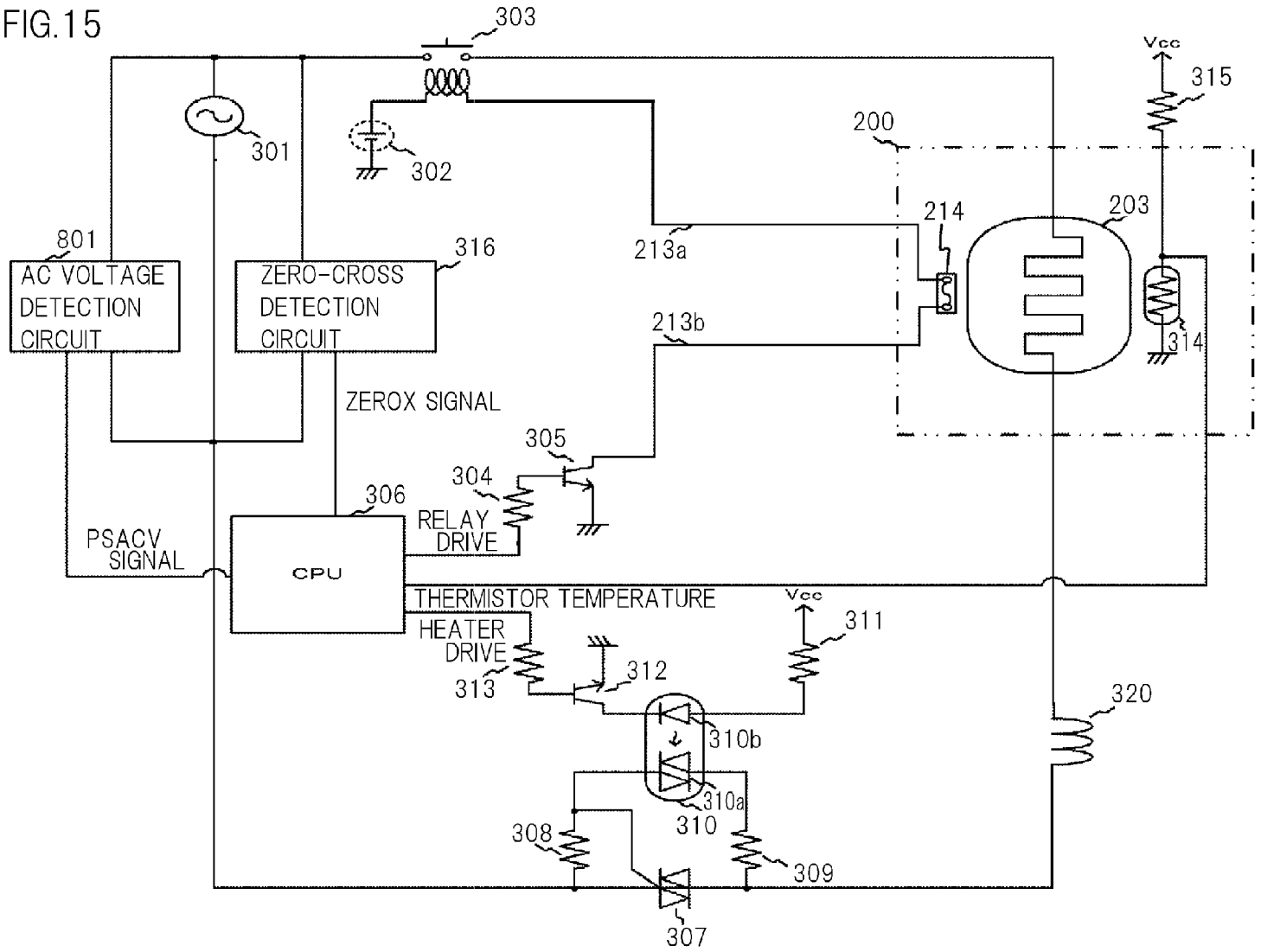
FIG. 15 is a circuit diagram showing a ceramic heater drive circuit according to a fourth embodiment.

FIG. 15 is a circuit diagram showing a ceramic heater drive circuit according to the fourth embodiment. In the AC voltage detection circuit 801, an input voltage from the commercial AC power source 301 is A/D converted and input as a digital value (called "PSACV" signal below) to the CPU 306. The CPU 306 detects the PSACV signal and determines the commercial AC power voltage.

Firstly, after switching on the power supply to the image-forming apparatus 100, the CPU 306 measures the PSACV signal ten times at intervals of 10 msec apart, and calculates the average value of 8 points excluding the largest and smallest values. If the average value is lower than a prescribed threshold value, then it is judged that the commercial AC voltage is 100 V, and if the average value is greater than the prescribed threshold value, then it is judged that the commercial AC voltage is 200 V. Thereupon, the CPU 306 samples the cycle of the ZEROX signal for five full-waves input from the zero-cross detection circuit 316, calculates the average value of three points excluding the largest and smallest values, and sets the reciprocal of this average value as the commercial AC frequency. The CPU 306 then determines the consecutive execution limit number (upper limit number) for heater switch-on control, in accordance with the above-mentioned combination of the commercial AC voltage and the commercial AC frequency.

Table 2 below indicates the relationship between the detected commercial AC voltage and commercial AC frequency, and the consecutive execution limit number of heater switch-on control. In the fourth embodiment, if the conditions in which flicker occurs are set to the most severe conditions of a commercial AC voltage of 200 V and a commercial AC frequency of 60 Hz or higher, then the consecutive execution limit number of heater switch-on control is set to one time. Furthermore, if the commercial AC voltage is 100 V and the commercial AC frequency is less than 60 Hz, then no limit is placed on the consecutive execution number of heater switch-on operations, and heater switch-on control is implemented in accordance with the target temperature. In the two cases apart from the foregoing, the heater switch-on consecutive execution limit number is set to two times.

TABLE 2

| | | AC voltage (V) | |
|---|---|---|---|
| | | 100 | 200 |
| AC frequency (Hz) | Less than 60 | No limit | Two times |
| | 60 or above | Two times | One time |

Figure 16:
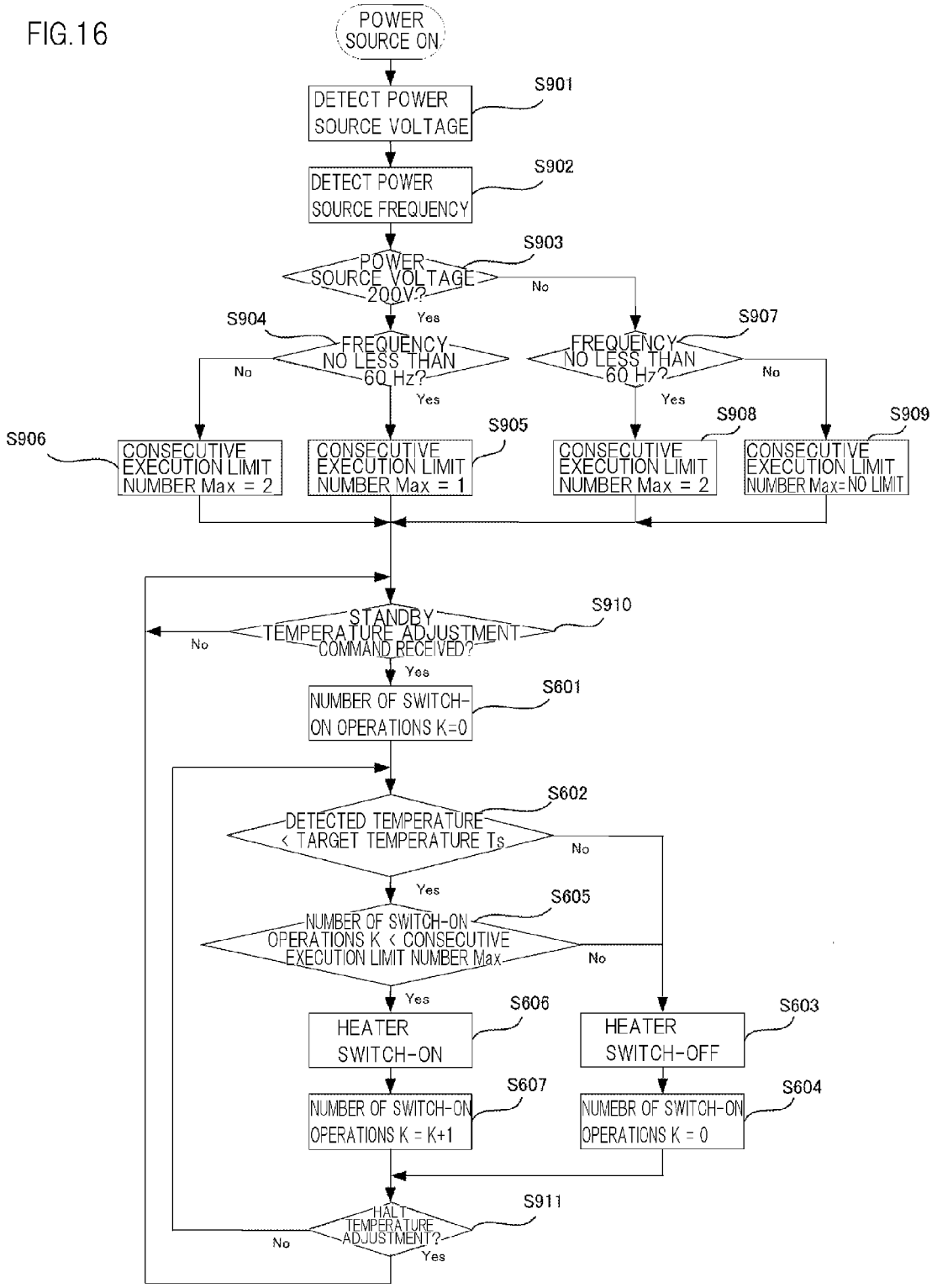
FIG. 16 is a flowchart of temperature control during standby according to the fourth embodiment.

Next, a method for determining the consecutive execution limit number Max according to the fourth embodiment, and the temperature control during standby, will be described with reference to FIG. 16. FIG. 16 is a flowchart of temperature control according to the fourth embodiment.

After switching on the power supply to the image-forming apparatus 100, the CPU 306 detects the power source voltage (S901), and detects the power source frequency (S902). Thereupon, the CPU 306 determines a consecutive execution limit number Max from the power source voltage detection results from S901 and the power source frequency detection results from S902.

Firstly, if it is determined that the power source voltage detection result in S901 is 200 V (Yes at S903), then the CPU 306 evaluates the power source frequency detection result from S902 (S904). If the frequency is equal to or greater than 60 Hz (Yes at S904), then the CPU 306 sets the consecutive execution limit number Max to one time (S905). If the frequency is less than 60 Hz (No at S904), then the CPU 306 sets the consecutive execution limit number Max to two times (S906).

On the other hand, if it is determined that the power source voltage detection result in S901 is 100 V (No at S903), then the CPU 306 evaluates the power source frequency detection result from S902 (S907). If the frequency is equal to or greater than 60 Hz (Yes at S907), then the CPU 306 sets the consecutive execution limit number Max to two times (S908). If the frequency is less than 60 Hz (No at S907), then the CPU 306 sets the consecutive execution limit number Max to no limit (S909).

The CPU 306 then waits until receiving a standby temperature control command (S910). During the standby process in S910, the CPU 306 is able to implement other control routines. For example, if a temperature control during printing command has been received, the CPU 306 is able to carry out temperature control during printing, in parallel with the standby process in the present flowchart.

If a standby temperature control command has been received (Yes at S910), then standby temperature control is implemented in accordance with one of the consecutive execution limit numbers Max selected in step S905, S906, S908 and S909. The standby temperature control in S601 to S607 of the flowchart is similar to that described in the flowchart in FIG. 13 of the third embodiment, and therefore further description thereof is omitted here. Subsequently, if a standby temperature adjustment halt command is received (No at S911), then the CPU 306 returns to S910, whereas if a halt command is not received (Yes at S911), then the standby temperature adjustment control is continued.

According to the fourth embodiment, since the heater switch-on consecutive execution limit number is determined in accordance with the detected commercial AC voltage and commercial AC frequency, it is possible to improve flicker suitably in accordance with the operating environment of the image-forming apparatus. The fourth embodiment was described with reference to one example of control in a case where the AC voltage detection circuit distinguishes between two voltage levels: 200V and 100V, but the commercial AC voltage values that can be detected and the number of voltage levels that can be distinguished may be changed by the composition of the AC voltage detection circuit. Furthermore, control was described with reference to a case where the commercial AC frequency is distinguished in two levels: 60 Hz or above and less than 60 Hz, but the detected frequencies and the number of distinguished frequency levels can also be changed. Furthermore, the heater switch-on consecutive execution limit number can be changed with respect to the detected voltage value and the detected frequency, and is not restricted to the limit numbers indicated in the present embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Applications No. 2013-218604, filed Oct. 21, 2013, and No. 2014-082873, filed Apr. 14, 2014 which are hereby incorporated by references herein in their entirety.

What is claimed is:

1. An image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source via a choke coil; and a control unit which controls the supply of power from the commercial AC power source to the heat generating member per one control cycle, wherein the control unit controls the supply of power to the heat generating member by control including phase control during printing for performing an image forming operation by the image forming unit, and controls the supply of power to the heat generating member by wave number control during standby for awaiting a print instruction, and wherein a time period whose length corresponds to the one control cycle during the standby is no less than 34 half-waves of AC wave forms.

2. The image-forming apparatus according to claim 1, wherein a current waveform flowing in the heat generating member on the basis of the wave number control is a specific waveform which is ON in specific phases during the one control cycle regardless of the temperature of the heat generating member.

3. The image-forming apparatus according to claim 1, wherein a waveform of the wave number control is a waveform in which an interval of no less than two half-waves is left between adjacent half-waves in which power is supplied.

4. The image-forming apparatus according to claim 3, wherein the interval between adjacent half-waves in which power is supplied in the wave number control is four half-waves.

5. The image-forming apparatus according to claim 1, wherein, of half-waves in which power is supplied during one control cycle of the wave number control, a second half-wave, which is at an interval of no less than two half-waves with respect to a first half-wave, has a smallest Plt value compared to a case where power is supplied in another half-wave which is at a different interval with respect to the first half-wave, and wherein the Plt value is a long term flicker perceptibility value based on International Electrotechnical Commission 61000-3-3.

6. The image-forming apparatus according to claim 1, wherein the fixing unit has a cylindrical fixing film.

7. The image-forming apparatus according to claim 6, wherein the heat generating member is formed on a heater substrate, and the heater substrate contacts an inner surface of the fixing film.

8. An image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source via a choke coil;

a detection unit which detects a temperature of the fixing unit; and a control unit which controls the supply of power from the commercial AC power source to the heat generating member, the control unit controlling the supply of power to the heat generating member by wave number control using a prescribed number of half-waves of alternating current as one control cycle, in such a manner that the temperature detected by the detection unit becomes a target temperature during standby for awaiting a print instruction, wherein the control unit does not supply power to the heat generating member when, during standby, the detected temperature is lower than the target temperature and power supply in one control cycle has been performed a limit number of times.

9. The image-forming apparatus according to claim 8, wherein the control unit does not supply power to the heat generating member for a time period equal to one control cycle, when, during standby, the detected temperature is lower than the target temperature and power supply in one control cycle has been performed the limit number of times.

10. The image-forming apparatus according to claim 8, wherein the limit number of times is determined on the basis of a commercial AC voltage and a commercial AC frequency.

11. The image-forming apparatus according to claim 8, wherein the number of half-waves in one control cycle of the wave number control during standby is set to be greater than the number of half-waves in one control cycle during printing for performing an image forming operation by the image forming unit.

12. The image-forming apparatus according to claim 8, wherein a current waveform flowing in the heat generating member on the basis of the wave number control is a specific waveform.

13. The image-forming apparatus according to claim 8, wherein the number of half-waves in one control cycle of the wave number control during standby is no less than 34.

14. The image-forming apparatus according to claim 13, wherein an interval between adjacent half-waves in which power supply is switched on in the wave number control during standby is no less than two half-waves.

15. The image-forming apparatus according to claim 14, wherein the interval between adjacent half-waves in which power supply is switched on in the wave number control during standby is four half-waves.

16. The image-forming apparatus according to claim 8, wherein the control unit implements phase control, or control combining phase control and wave number control, as control of the supply of power during printing for performing an image forming operation by the image forming unit.

17. The image-forming apparatus according to claim 8, wherein the fixing unit has a cylindrical fixing film.

18. The image-forming apparatus according to claim 17, wherein the heat generating member is formed on a heater substrate, and the heater substrate contacts an inner surface of the fixing film.

19. An image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source; and a control unit which controls the supply of power from the commercial AC power source to the heat generating member per one control cycle, wherein the control unit controls the supply of power to the heat generating member by control including phase control during printing for performing an image forming operation by the image forming unit, and controls the supply of power to the heat generating member by wave number control during standby for awaiting a print instruction, and wherein a current waveform flowing in the heat generating member on the basis of the wave number control is of one type, regardless of a temperature of the heat generating member.

20. The image-forming apparatus according to claim 19, wherein a time period whose length corresponds to the one control cycle during the standby is no less than 34 half-waves of AC wave forms.

21. The image-forming apparatus according to claim 19, wherein the fixing unit has a cylindrical fixing film.

22. The image-forming apparatus according to claim 21, wherein the heat generating member is formed on a heater substrate, and the heater substrate contacts an inner surface of the fixing film.

23. An image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source; and a control unit which controls the supply of power from the commercial AC power source to the heat generating member per one control cycle, wherein the control unit controls the supply of power to the heat generating member by wave number control during standby for awaiting a print instruction, and wherein a time period whose length corresponds to the one control cycle during the standby is no less than 34 half-waves of AC wave forms.

24. The image-forming apparatus according to claim 23, wherein the fixing unit has a cylindrical fixing film.

25. The image-forming apparatus according to claim 24, wherein the heat generating member is formed on a heater substrate, and the heater substrate contacts an inner surface of the fixing film.

26. An image-forming apparatus, comprising:

an image forming unit which forms an unfixed toner image on a recording material;

a fixing unit which heats the unfixed toner image formed by the image forming unit and fixes the image to the recording material, the fixing unit having a heat generating member which generates heat by power supplied from a commercial AC power source; and a control unit which controls the supply of power from the commercial AC power source to the heat generating member per one control cycle, wherein the control unit controls the supply of power to the heat generating member by control combining phase control and wave number control during printing for performing an image forming operation by the image forming unit, and controls the supply of power to the heat generating member by wave number control during standby for awaiting a print instruction, and wherein a time period whose length corresponds to the one control cycle during the standby is longer than that during the printing.

27. The image-forming apparatus according to claim 26, wherein a time period whose length corresponds to the one control cycle during the standby is no less than 34 half-waves of AC wave forms.

28. The image-forming apparatus according to claim 26, wherein the fixing unit has a cylindrical fixing film.

29. The image-forming apparatus according to claim 28, wherein the heat generating member is formed on a heater substrate, and the heater substrate contacts an inner surface of the fixing film.

* * * * *